US011318054B2

(12) United States Patent
Thompson et al.

(10) Patent No.: US 11,318,054 B2
(45) **Date of Patent: *May 3, 2022**

(54) TRACK DRIVE MODULE FOR AN EMERGENCY STRETCHER

(71) Applicants: Bradley Michael Thompson, Arnprior (CA); Rodney Eugene Thompson, Pakenham (CA); Jason Christopher Watt, Pakenham (CA); James Robert Dodge, Arnprior (CA); Julian Jan Oscroft, Carp (CA)

(72) Inventors: Bradley Michael Thompson, Arnprior (CA); Rodney Eugene Thompson, Pakenham (CA); Jason Christopher Watt, Pakenham (CA); James Robert Dodge, Arnprior (CA); Julian Jan Oscroft, Carp (CA)

( * ) Notice: Subject to any disclaimer, the term of this patent is extended or adjusted under 35 U.S.C. 154(b) by 120 days.

This patent is subject to a terminal disclaimer.

(21) Appl. No.: 16/834,070

(22) Filed: Mar. 30, 2020

(65) Prior Publication Data

US 2020/0397632 A1 Dec. 24, 2020

Related U.S. Application Data

(60) Provisional application No. 62/864,243, filed on Jun. 20, 2019.

(51) Int. Cl.
*A61G 3/08* (2006.01)
*A61G 3/06* (2006.01)
(Continued)

(52) U.S. Cl.
CPC ..... *A61G 1/0275* (2013.01); *A61G 1/025* (2013.01); *A61G 1/0237* (2013.01); *A61G 3/062* (2013.01);
(Continued)

(58) Field of Classification Search
CPC .... A61G 3/001; A61G 3/0218; A61G 1/0237; A61G 1/025; A61G 3/062; A61G 3/0875; A62C 27/00
See application file for complete search history.

(56) References Cited

U.S. PATENT DOCUMENTS 8,025,325 B1 * 9/2011 Carrier ..... A62C 27/00 296/19
2006/0195987 A1 9/2006 Walkingshaw
2014/0265181 A1 * 9/2014 Lambarth ..... A61G 1/04 280/28.5

FOREIGN PATENT DOCUMENTS

CA 2185471 A1 10/1996
CN 203790154 U 8/2014
(Continued)

OTHER PUBLICATIONS

Wikipedia page for Stretcher, https://en.wikipedia.org/wiki/Stretcher, accessed Mar. 19, 2020.
(Continued)

*Primary Examiner* — David R Hare
*Assistant Examiner* — Madison Emanski
(74) *Attorney, Agent, or Firm* — Noblitt & Newson, PLLC

(57) ABSTRACT

A self-propelled track drive module for an emergency stretcher, includes a left-side track drive unit and a right-side track drive unit. A frame, having a front end and a rear end, is disposed between the left-side track drive unit and the right-side track drive unit. The frame has a mounting structure for receiving an emergency stretcher and for releasably securing the emergency stretcher to the frame. The mounting structure is configured to support the emergency stretcher such that rolling wheels of the emergency stretcher do not
(Continued)

contact a ground surface therebelow when the emergency stretcher is in a mounted condition.

16 Claims, 6 Drawing Sheets

(51) Int. Cl.

| | |
|---|---|
| ***A62C 27/00*** | (2006.01) |
| ***A61G 3/00*** | (2006.01) |
| ***A61G 3/02*** | (2006.01) |
| ***A61G 1/02*** | (2006.01) |

(52) U.S. Cl.
CPC ..... *A61G 3/0875* (2013.01); *A62C 27/00* (2013.01); *A61G 3/001* (2013.01); *A61G 3/0218* (2013.01)

(56) References Cited

FOREIGN PATENT DOCUMENTS

| | | | |
|---|---|---|---|
| CN | 204121284 | U | 1/2015 |
| CN | 106109110 | A | 11/2016 |
| CN | 206612892 | U | 11/2017 |
| FR | 2883243 | B1 | 9/2006 |
| RU | 2542827 | C1 | 2/2015 |
| SE | 8803877 | | 10/1988 |
| WO | 2004039300 | A1 | 5/2004 |

OTHER PUBLICATIONS

Stryker Stair-PRO Model No. 6252, https://www.stryker.com/us/en/emergency-care/products/stair-pro.html, accessed Mar. 19, 2020.

* cited by examiner

TRACK DRIVE MODULE FOR AN EMERGENCY STRETCHER

CROSS-REFERENCES TO RELATED APPLICATIONS

This application claims the benefit of U.S. Provisional Patent Application No. 62/864,243, filed Jun. 20, 2019, and incorporates the disclosure of the application by reference.

FIELD OF THE INVENTION

The present disclosure relates generally to an emergency stretcher of the type that is used to transport patients in an ambulance or within a hospital. More particularly, the present disclosure relates to a self-propelled track drive module that can be releasably secured to an emergency stretcher for use on uneven or loosely packed surfaces.

BACKGROUND

Emergency stretchers are known for transporting patients in an ambulance and for transporting patients within a hospital. A typical emergency stretcher includes a patient litter or cot that is supported on an X-frame undercarriage equipped with wheels. The X-frame (scissor lift) allows the patient litter to be raised and lowered to facilitate loading of a patient onto the litter, loading the stretcher into an ambulance and subsequently unloading the stretcher from the ambulance, etc. Although the prior art emergency stretchers are generally adequate for their intended purposes, they are not satisfactory in all regards.

Known emergency stretchers are constructed to move on a set of caster wheels, which are suitable for use on smooth surfaces including hospital floors, concrete pathways, paved driveways, etc. As will be apparent, the caster wheels are not well suited for use on uneven or loosely packed surfaces including gravel driveways, deep snow, sand, cobblestone walkways, grass, fields, wooded areas etc. When operated on uneven or loosely packed surfaces the caster wheels of a prior art emergency stretcher may become obstructed, entangled or buried, making it difficult or even impossible for emergency medical service (EMS) providers to transport a patient in the normal fashion. Under such conditions it may be necessary to use a specialized patient transport vehicle, such as for instance an all-terrain vehicle equipped with a patient litter. Alternatively, it may be necessary for the EMS providers to lift the stretcher, including the patient and any medical equipment associated therewith, over the uneven or loosely packed surface.

Of course, a specialized transport vehicle may not be readily available and therefore valuable time may be wasted waiting for such a vehicle to arrive. On the other hand, lifting the stretcher including the patient and medical equipment, even over a short distance, unacceptably increases the risk of an injury occurring to the EMS providers and/or volunteers assisting with the patient transport.

In fact, the problem of injuries occurring to EMS providers during patient transport is a serious and long-standing one. According to a study that was published in December 2007 (Studnek et al., "On the job illness and injury resulting in lost work time among a national cohort of emergency medical services professionals," *American Journal of Industrial Medicine*, Vol. 50, Issue 12, pp. 921-931) almost 10% of all emergency medical technicians and paramedics in the United States at any given time were missing work because of a job-related injury or illness, which increases to almost 19% in busy systems that handle more than 40 calls per week. The most common types of injuries, accounting for nearly 30% of all workplace injuries and illness occurring in EMS providers, are body motion injuries including back and neck sprains and strains caused by excessive physical effort, awkward posture or repetitive movement. Slips, trips and falls account for another 15% of workplace injuries and illness in EMS providers, wherein 40% of such incidents involved the EMS provider going up or down a step or curb.

The high incidence of workplace injuries in EMS providers may be attributed to performing repetitive movements while lifting or moving a heavy load. For instance, a prior art stretcher weighs approximately 120 pounds when empty, but the total weight may exceed 350 pounds when loaded with a patient and medical equipment. In the case of bariatric patient transfer the total weight that is being transported exceeds 350 pounds by a considerable amount. Other factors that contribute to the occurrence of workplace injuries include shifting of the patient's balance or position while being transported, which requires the EMS provider to compensate, or manoeuvring through narrow passages, which requires the EMS provider to bend or twist.

Another problem associated with prior art emergency stretchers is that two EMS providers are required to transport a patient safely—one EMS provider guiding the foot-end of the stretcher and the other EMS provider guiding the head-end of the stretcher. As a result, neither EMS provider is available to retrieve equipment from the ambulance or to attend to another patient, etc.

Further, the prior art emergency stretcher is typically moved with the patient litter in the raised position. Although this configuration allows the EMS providers to move the patient without being required to bend down to reach the patient litter, it also has the unfortunate effect of raising the centre of mass, which increases the likelihood that the emergency stretcher will tip over. Tipping of the emergency stretcher is undesirable because the patient being transported may be thrown to the ground, causing bodily harm to the patient, and/or the EMS providers may suffer an injury while attempting to compensate for the tipping motion.

It would therefore be beneficial to provide methods and apparatus that overcome at least some of the above-mentioned disadvantages and/or limitations that are associated with prior art emergency stretchers.

SUMMARY OF THE INVENTION

In accordance with an aspect of at least one embodiment there is provided a self-propelled track drive module for an emergency stretcher, comprising: a left-side track drive unit and a right-side track drive unit; and a frame having a front end and a rear end and being disposed between the left-side track drive unit and the right-side track drive unit, the frame comprising a mounting structure for receiving an emergency stretcher and for releasably securing the emergency stretcher to the frame, wherein the mounting structure is configured to support the emergency stretcher such that rolling wheels of the emergency stretcher do not contact a ground surface therebelow when the emergency stretcher is in a mounted condition.

In accordance with an aspect of at least one embodiment there is provided a system for transporting a patient, comprising: an emergency stretcher comprising: a bed upon which the patient is placed for transport; a scissor lift assembly supporting the bed in a height-adjustable fashion; and a first set of caster wheels carried by the front-end of the scissor lift and a second set of caster wheels carried by the rear-end of the scissor lift; and a self-propelled track drive module, comprising: a left-side track drive unit and a right-side track drive unit; and a frame having a front end and a rear end and being disposed between the left-side track drive unit and the right-side track drive unit, the frame comprising a mounting structure for receiving the emergency stretcher and for releasably securing the emergency stretcher to the frame, wherein the mounting structure is configured to support the emergency stretcher such that the first set of caster wheels and the second set of caster wheels do not contact a ground surface therebelow when the emergency stretcher is in a mounted condition.

In accordance with an aspect of at least one embodiment there is provided a method for transporting a patient, comprising: releasably securing an emergency stretcher to a self-propelled track drive module, wherein: the emergency stretcher comprises a bed upon which the patient is placed for transport, a scissor lift system for supporting the bed in a height-adjustable fashion, and a set of caster wheels for rolling on a ground surface; and the self-propelled track drive module comprises a left-side track drive unit and a right-side track drive unit and a frame having a front end and a rear end and being disposed between the left-side track drive unit and the right-side track drive unit, the frame comprising a mounting structure for receiving the emergency; and wherein the caster wheels do not contact a ground surface therebelow when the emergency stretcher is mounted to the self-propelled track drive module; transporting the patient over a first terrain in a self-propelled mode of operation in which the tracks of the self-propelled track drive module engage a ground surface of the first terrain and are powered by an on-board power plant thereof; releasing the emergency stretcher from the self-propelled track drive module and placing the set of caster wheels into contact with a ground surface of a second terrain; and transporting the patient over the ground surface of the second terrain in a manually propelled mode of operation in which the emergency stretcher rolls on the set of caster wheels.

BRIEF DESCRIPTION OF THE DRAWINGS

The instant invention will now be described by way of example only, and with reference to the attached drawings, wherein similar reference numerals denote similar elements throughout the several views, and in which.

DETAILED DESCRIPTION OF EMBODIMENTS OF THE INVENTION

The following description is presented to enable a person skilled in the art to make and use the invention and is provided in the context of a particular application and its requirements. Various modifications to the disclosed embodiments will be readily apparent to those skilled in the art, and the general principles defined herein may be applied to other embodiments and applications without departing from the scope of the invention. Thus, the present invention is not intended to be limited to the embodiments disclosed but is to be accorded the widest scope consistent with the principles and features disclosed herein.

Throughout the description and in the appended claims the terms "left" and "right" are understood to be with respect to an operator positioned at the foot end of the emergency stretcher and facing toward the emergency stretcher. The term "front" refers to the head end of the emergency stretcher and the term "rear" refers to the foot end of the emergency stretcher.

Figure 1:
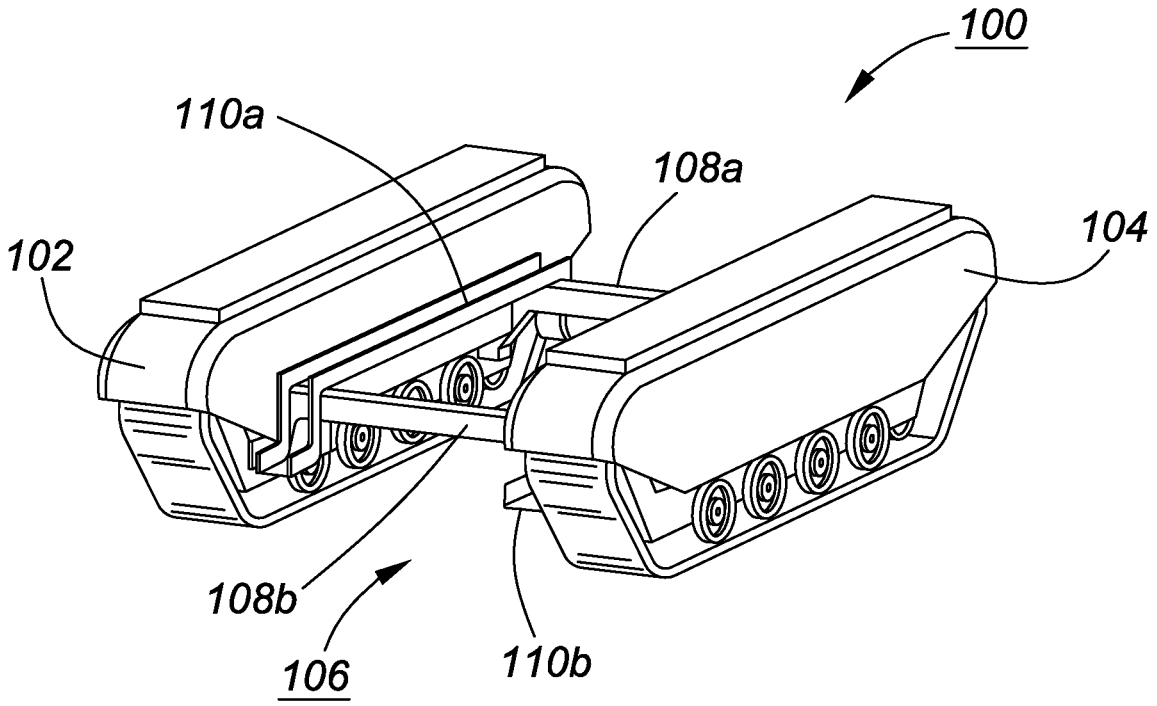
FIG. 1 is a simplified perspective view of a track drive module for an emergency stretcher according to an embodiment.
Figure 2:
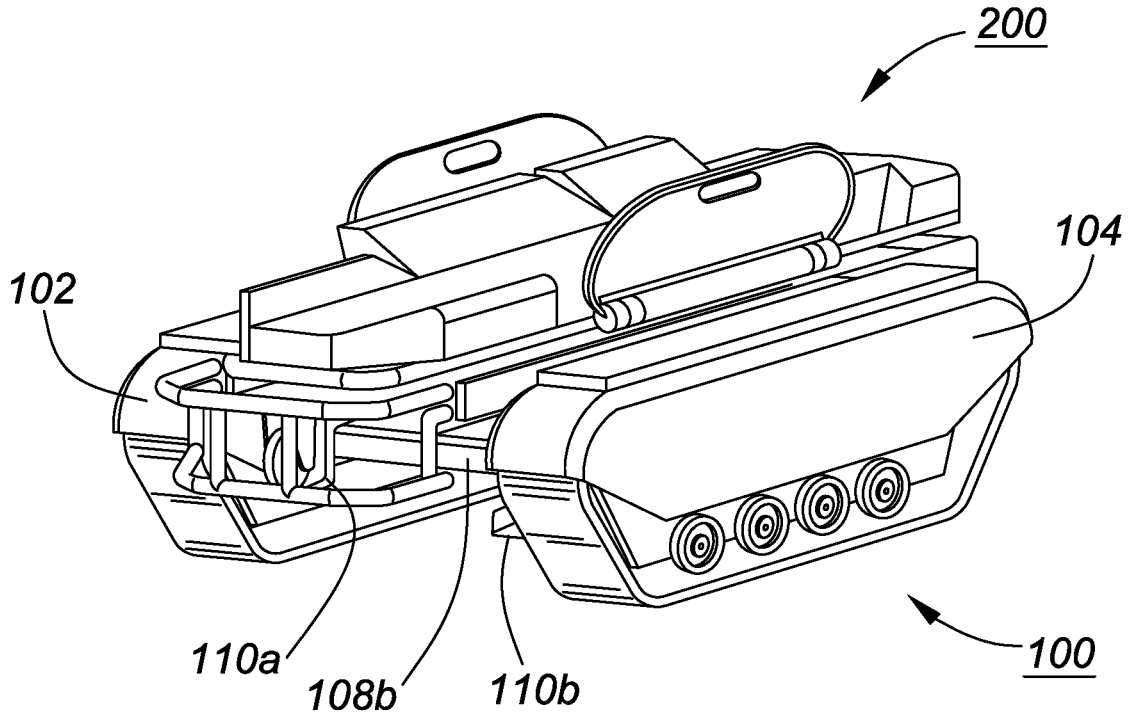
FIG. 2 is a simplified perspective view of the track drive module of FIG. 1 with an emergency stretcher mounted thereon and in a lowered configuration.
Figure 3:
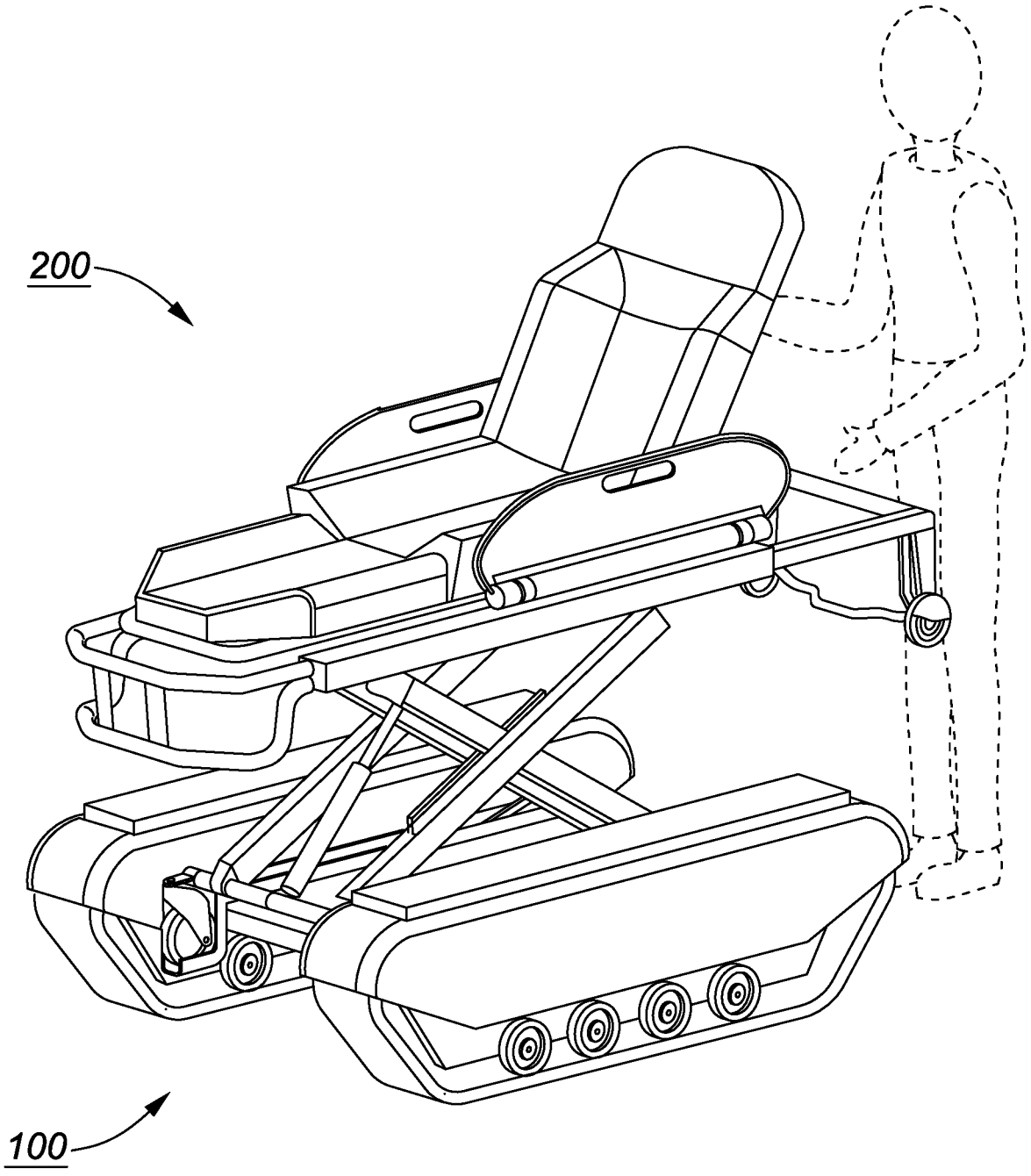
FIG. 3 is a simplified perspective view of the track drive module of FIG. 1 with an emergency stretcher mounted thereon and in a raised configuration.

Referring to FIG. 1, shown is a simplified perspective view of a track drive module 100 for an emergency stretcher, according to an embodiment. The track drive module 100 includes a left-side track drive unit 102 and a right-side track drive unit 104. The track drive units 102 and 104 are mounted to a frame shown generally at 106. In the specific and non-limiting example that is shown in FIG. 1 the frame comprises front 108*a* and rear 108*b* cross-member supports, as well as left and right longitudinal rails 110*a* and 110*b*, respectively. The longitudinal rails are generally U-shaped with an open top and extend to form a total of four channel supports, which form emergency stretcher wheel tracks. Two channel supports are formed adjacent the front cross-member 108*a* of the frame 106 and two channel supports are formed adjacent the rear cross-member 108*b* of the frame 106. Now referring also to FIG. 2 and FIG. 3, shown are perspective views of an emergency stretcher 200 mounted on the track drive module 100, with a bed of the emergency stretcher 200 in a lowered condition (FIG. 2) and in a raised condition (FIG. 3). Caster wheels that are carried by a scissor lift mechanism of the emergency stretcher 200 are received one each within one of the four channel supports when the emergency stretcher is mounted to the track drive module 100. Notably, the caster wheels do not contact a ground surface therebelow when the emergency stretcher is in a mounted condition on the track drive module. In fact, the channel supports ensure that the caster wheels are supported at a height above the ground surface that is sufficient to prevent the caster wheels from becoming entangled with objects such as branches, grass, rocks etc. that may be present on uneven terrain.

The track drive module 100 also includes a power plant (which is not illustrated in FIG. 1). In an embodiment the power plant includes at least one or more electric motor for driving the left-side and right-side track drive units 102 and 104, respectively, and one or more battery for powering the one or more electric motor. Preferably, the one or more electric motors includes two electric motors, one each for powering the left-side and right-side track drive units 102 and 104, respectively. Alternatively, the power plant may include a gasoline-powered or a diesel-powered motor and an associated fuel reservoir. Additionally, the track drive units 102 and 104 of the track drive module 100 also include standard safety features such as for instance parking brake and service brake mechanisms, which may be the same or different mechanisms. During use, the not illustrated power plant provides power to the left-side track unit 102 and to the right-side track unit 104 for operating the track drive module 100 over a ground surface.

The track drive module 100 that is shown in FIG. 1 optionally includes additional elements or components that may find use during patient transfer and care. For instance, a not illustrated support pole may be provided for supporting e.g., intravenous drip bags. A not illustrated lighting unit, such as for instance an LED lighting unit, may be disposed on the support pole or at another suitable attachment point on the track drive module 100. The lighting unit may be powered by the power plant of the track drive module or by a separate battery pack. The lighting unit may be a single module, which may provide one or more of scene lighting, driving lighting and emergency lighting. Optionally, the lighting unit includes plural lighting units, each of which provides only some of scene lighting, driving lighting or emergency lighting. A not illustrated control frame may be provided at one end of the track drive module 100, which may serve as a handle for pushing or pulling the track drive module and may provide rollover protection for the patient. Pushing or pulling the track drive module may be necessary under certain conditions, such as for instance when the tracks become stuck in mud or when guiding the track drive module over uneven obstacles. Alternatively, a wireless or a wired control box may be quickly secured to the back of the emergency stretcher 200 when the emergency stretcher 200 is secured to the track drive module 100. The operator may adjust the height of the emergency stretcher 200 to an ergonomically acceptable position to allow the operator to walk behind and operate the track drive module 100 comfortably and safely using the wireless or wired control box. Various electronic modules may be mounted to the control frame as well, such as for instance an operator control unit for controlling the track drive module and/or a patient monitoring system for providing patient monitoring system readout and communications functionality. For instance, the patient monitoring system may support on board two-way digital video communications with hospital and trauma doctors. Optionally, a wireless control unit is carried by an operator of the track drive module for operating the track drive module from a distance.

Of course, the emergency stretcher optionally includes additional actuators and mechanisms for inclining the bed, either in whole or in part. For instance, the head end of the bed may be pivotally coupled to the foot end such that the head end may be inclined as shown in FIG. 3 to allow the patient to assume a semi-sitting position. Alternatively, the head end of the bed may be pivoted down to allow the patient to lie flat as shown in FIG. 2. Further alternatively, the foot end of the bed may be inclined to place the patient in "shock position." Of course, restraint straps or other devices for securing the patient to the bed may be provided in the known fashion.

Figure 4:
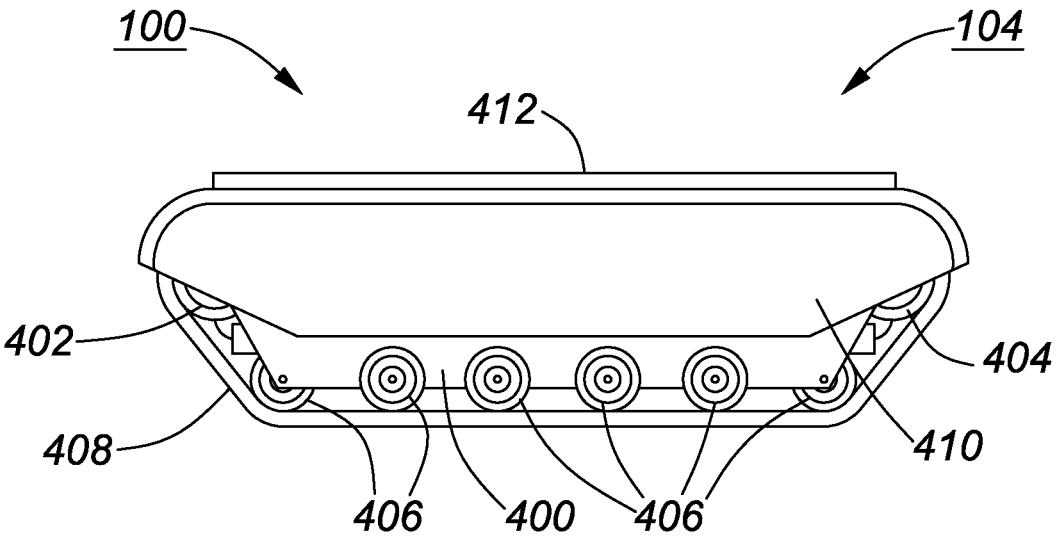
FIG. 4 is a simplified side view of the track drive module of FIG. 1.
Figure 5:
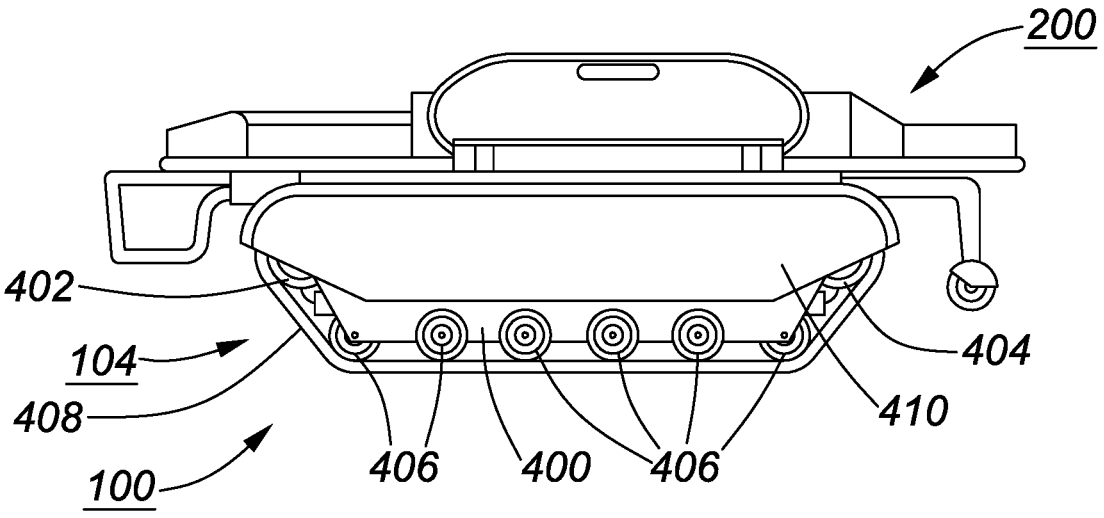
FIG. 5 is a simplified side view of the track drive module of FIG. 1 with an emergency stretcher mounted thereon and in a lowered configuration.
Figure 6:
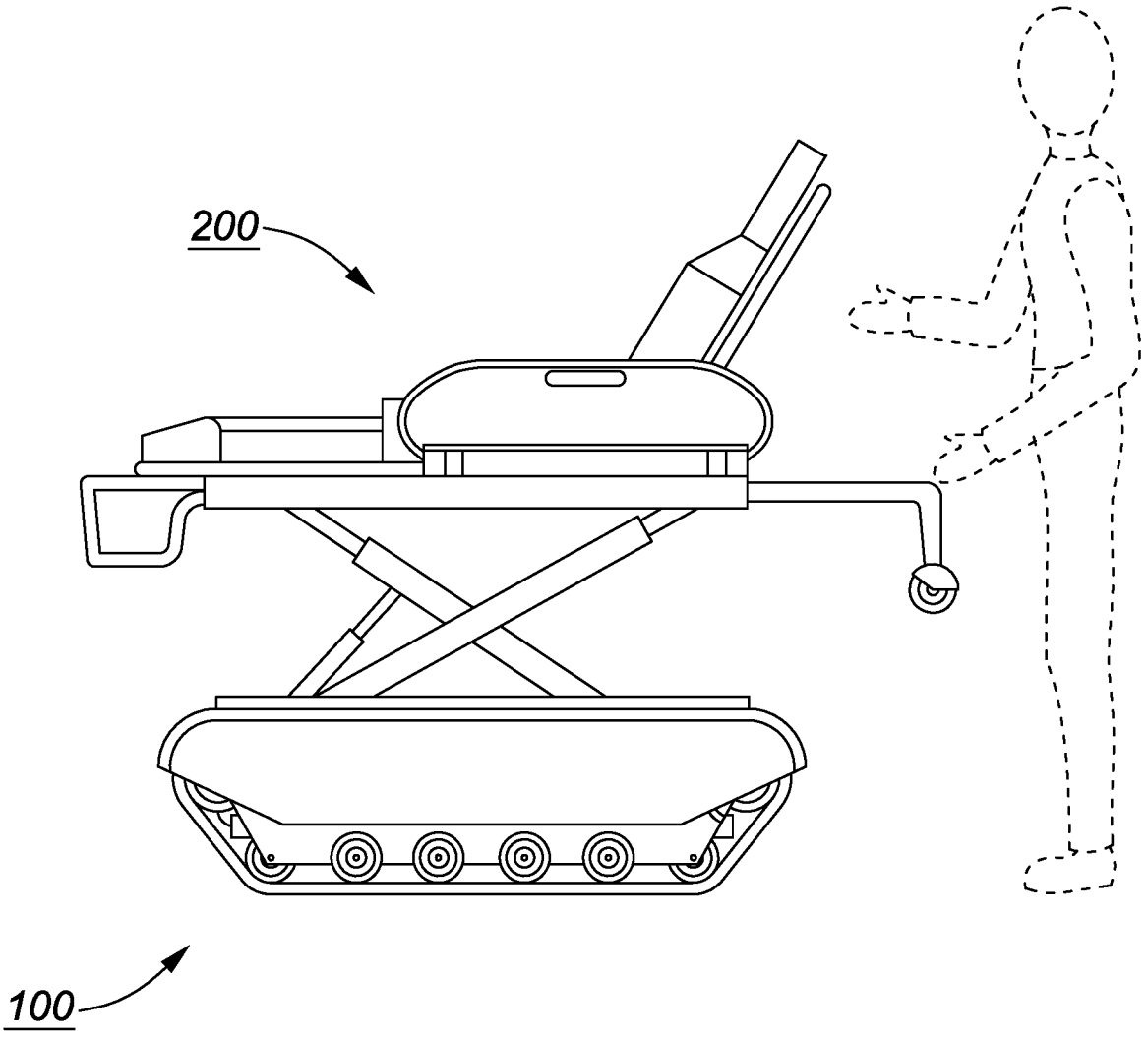
FIG. 6 is a simplified side view of the track drive module of FIG. 1 with an emergency stretcher mounted thereon and in a raised configuration.

FIG. 4 is a side view of the track drive module 100, in which only the right-side track drive unit 104 is visible. The right-side track drive unit 104 includes an undercarriage frame 400 which supports drive sprocket 402 and also a plurality of idler wheels 404 and 406. Track 408 is driven by the drive sprocket 402 and the idler wheels 404 and 406 are guided to run on the track 408, thereby allowing the track drive module 100 to operate over any type of ground surface. A cover 410 is provided to protect the operator and the patient from moving parts of the right-side track drive unit 104. Optionally, a kneeling pad 412 fabricated from a soft or cushioning material is provided along the top surface of the cover 410, which provides a place for the operator to kneel when attending to the patient and provides leverage when adjusting the position of the patient, etc. Now referring also to FIG. 5 and FIG. 6, shown are side views of the emergency stretcher 200 mounted on the track drive module 100, with a bed of the emergency stretcher 200 in a lowered condition (FIG. 5) and in a raised condition (FIG. 6), respectively. Of course, the left-side track drive unit 102 (not shown in FIG. 4, 5 or 6) is substantially a mirror image of the right-side track drive unit 104 and includes all of the same components that are discussed above with reference to the right-side track drive unit 104. The same reference characters will therefore be used below when referring to the left-side track drive unit 102.

In an exemplary embodiment, a left-side electric drive motor (not illustrated) is mounted to the undercarriage frame 400 of the left-side track drive unit 102 and a right-side electric drive motor (not illustrated) is mounted to the undercarriage frame 400 of the right-side track drive unit 104. During use, the not illustrated left-side electric drive motor powers the left-side track drive unit 102 via a not illustrated left-side power transfer unit coupled to the drive sprocket of the left-side track drive unit 102. Similarly, the not illustrated right-side electric drive motor powers the right-side track unit 104 via a not illustrated right-side power transfer unit coupled to the drive sprocket 402 of the right-side track drive unit 104. Advantageously, the left-side track drive unit 102 and the right-side track drive unit 104 are powered independently in order to improve maneuverability of the track drive module 100, such as for instance by enabling the tracks to counter rotate for maneuvering in tight areas.

Figure 7:
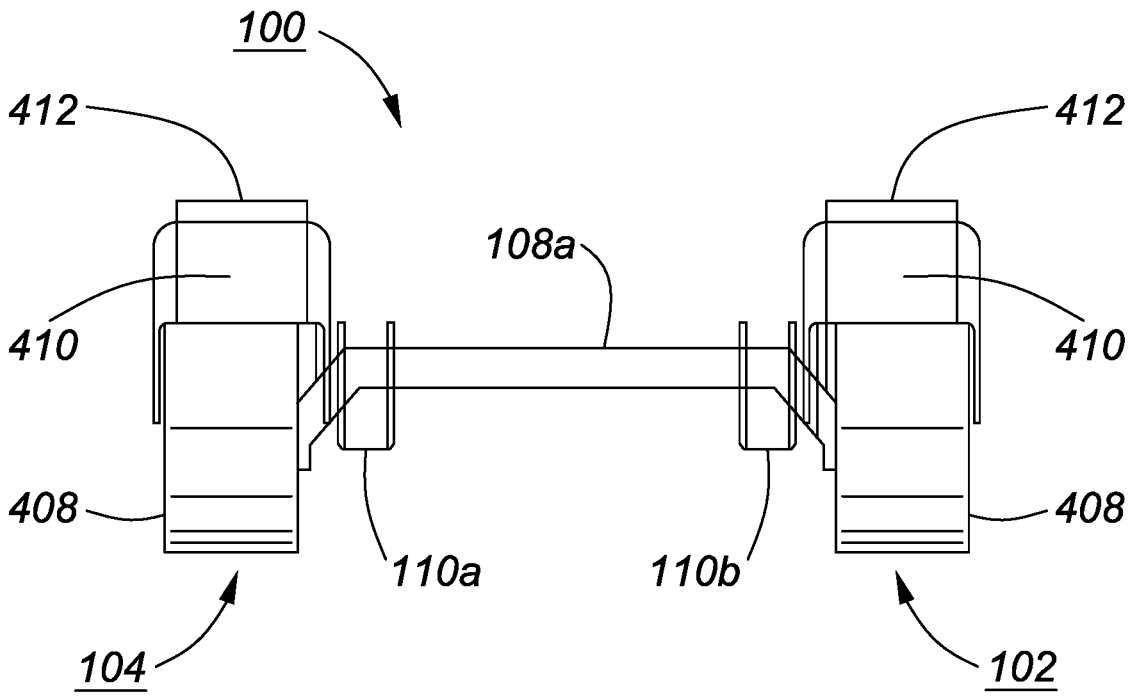
FIG. 7 is a simplified front view of the track drive module of FIG. 1.
Figure 8:
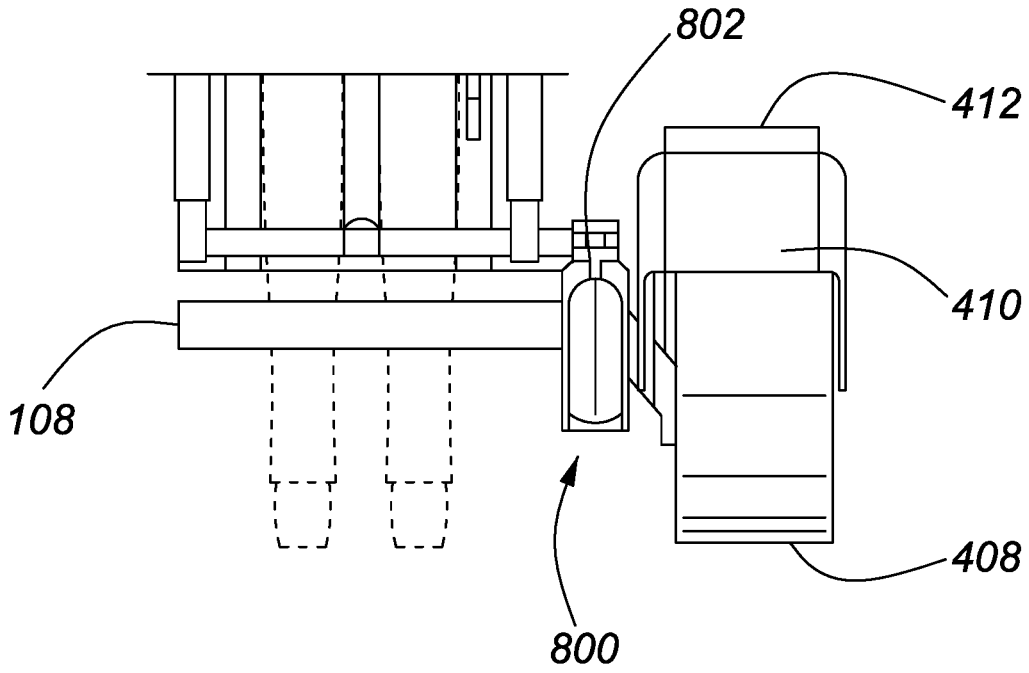
FIG. 8 is a simplified partial front view of the track drive module of FIG. 1 with an emergency stretcher mounted thereon and in a lowered configuration, showing detail of the mounting structure.
Figure 9:
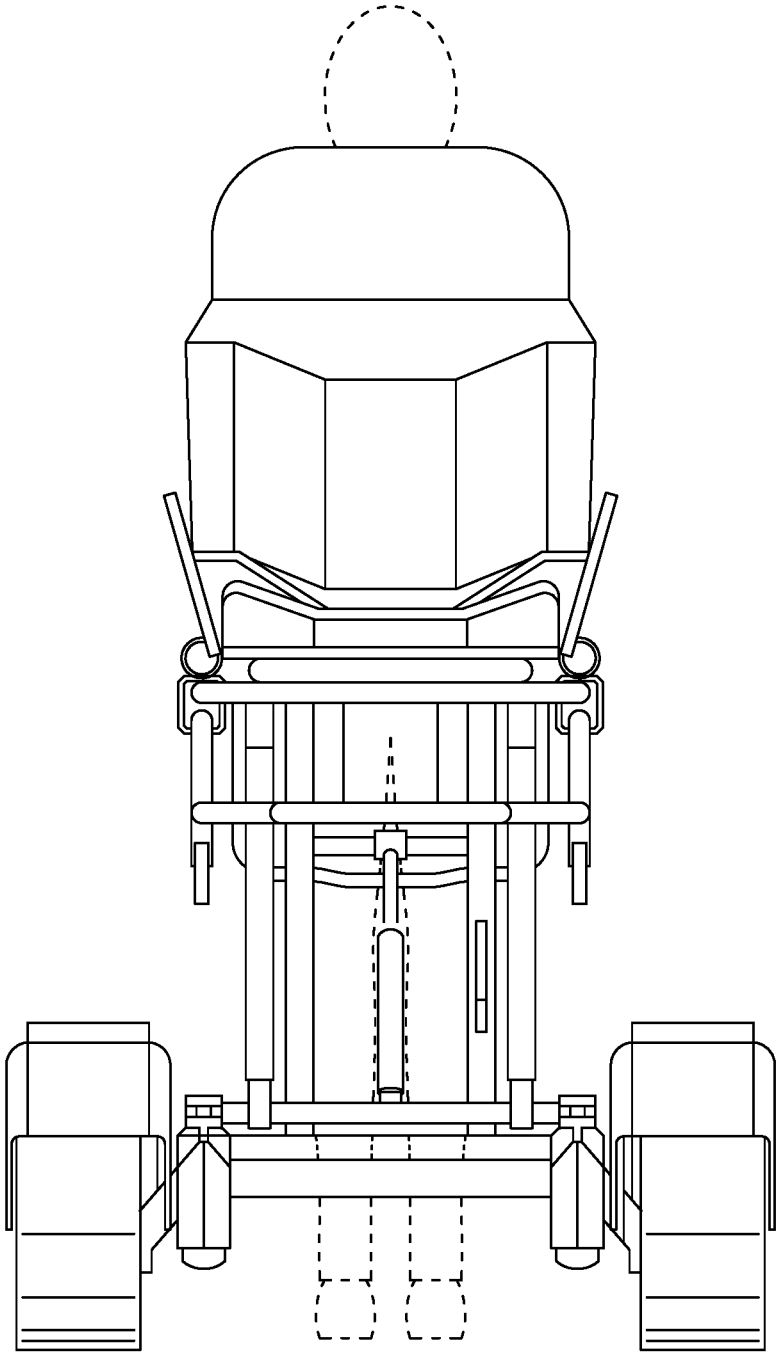
FIG. 9 is a simplified front view of the track drive module of FIG. 1 with an emergency stretcher mounted thereon and in a raised configuration.

Referring now to FIGS. 7, 8 and 9, shown is a simplified front view of the track drive module 100, an enlarged partial front view showing detail of the structure of the channel support, and a simplified front view of the track drive module 100 with an emergency stretcher 200 mounted thereto in a raised condition, respectively. In the specific and non-limiting embodiment that is shown in the above-mentioned figures, the channel support 800 (which more specifically is the front-left channel support) is sized and positioned to receive caster wheel 802 of the emergency stretcher 200, such that caster wheel 802 is substantially parallel to the track 408. Similarly, the front-right, rear-left and rear-right channel supports receive corresponding caster wheels in substantially the same fashion.

In an alternative embodiment (not illustrated) the front-left and front-right channel supports are replaced by a single front tray with raised edges, which is sized and positioned for receiving and supporting both of the front casters wheels of the emergency stretcher 200 (i.e., the caster wheels that are carried at the head-end of the scissor lift). Similarly, in the alternative embodiment the rear-left and rear-right channel supports are replaced by a single rear tray with raised edges, which is sized and positioned for receiving and supporting both of the rear caster wheels of the emergency stretcher 200 (i.e., the caster wheels that are carried at the foot-end of the scissor lift). In both embodiments, the caster wheels of the emergency stretcher are supported out of contact with the ground surface therebelow and are protected from various obstacles on the uneven terrain as was discussed above.

The track drive module 100 and the emergency stretcher 200 cooperate to form a self-propelled patient transfer system. Since the system uses a standard emergency stretcher 200 it is not necessary to modify existing ambulances etc., which are already configured for transporting the standard emergency stretcher 200. Further, the standard emergency stretcher 200 is used to transport the patient from the ambulance to the hospital, and therefore no special accommodations need to be made in hospital emergency rooms etc. The detachable nature of the track drive module 100 provides a versatile system, which may be used for transporting patients over surfaces that are even, smooth and hard-packed as well as over surfaces that are uneven, hilly, soft-packed or obstructed by branches, rocks or steps etc.

When a patient is being transferred over even, hard surfaces etc. it is not necessary to use the track drive module 100 with the emergency stretcher 200. For instance, transporting a patient down a paved driveway or between an ambulance and a hospital entrance may be done in the known way by simply rolling the emergency stretcher on the caster wheels.

Of course, when a patient is being transferred over uneven or soft-packed surfaces the caster wheels may become entangled, sink into the ground, or otherwise unable to roll. Under such circumstances it is advantageous to use the track drive module 100 with the emergency stretcher 200. A procedure for transporting a patient over such surfaces may include the following sequence of steps, but it is to be understood that some steps may be omitted, other steps may be added, and some steps may be performed in a different order. To begin, the emergency stretcher 200 is provided, such as for example by unloading the emergency stretcher 200 from the back of an ambulance. The track drive module 100 is then provided next to the emergency stretcher 200. The track drive module 100 may be stowed within the ambulance and unloaded at the scene, or it may be delivered by a special unit upon request. The emergency stretcher 200 is then mounted onto the track drive module 100 and is secured thereto. The operator then uses a controller to drive the track drive module 100 under its own power directly to the patient requiring transport, which includes driving the track drive module 100 over the uneven or soft-packed surface. After the patient is secured in the bed of the emergency stretcher 200, and preferably with the emergency stretcher 200 in the lowered condition, the track drive module 100 is driven back toward the ambulance, which once again includes driving the track drive module 100 over the uneven or soft-packed surface. The emergency stretcher 200 is uncoupled from the track drive module 100 and the caster wheels of the emergency stretcher 200 are placed into contact with the ground. The patient is then either wheeled across the ground to the ambulance or is loaded directly into the back of the ambulance while still secured to the emergency stretcher 200. Finally, the track drive module is either stowed back in its place within the ambulance or it is returned to the special unit to be removed from the scene. Optionally, the track drive module 100 may be driven over even or uneven ground with the emergency stretcher 200 in the raised or semi-raised condition so as to improve operator comfort and to reduce the risk of operator injury. Further optionally, the emergency stretcher 200 and the track drive module 100 can remain coupled together, with the patient secured on the emergency stretcher 200, and be loaded into an ambulance that is equipped for loading and securing the coupled together emergency stretcher 200 and the track drive module 100 as a unit.

During use, the operator may cause the left track drive unit 102 and the right track drive unit 104 to rotate in the same direction forward or reverse, or to counter-rotate so as to turn or even spin on the spot. The tracks 408 are capable of driving the track drive module 100 and emergency stretcher 200 over terrain that includes rocks, sticks, ditches, inclines, stairs, curbs, sand, snow, mud, gravel, grass etc. When transporting a patient across the types of non-standard terrains that are mentioned above it is recommended for two operators (i.e., EMS providers) to accompany the emergency stretcher, and it is recommended that the emergency stretcher is in the lowered condition in order to lower the center of gravity and thereby increase the stability of the unit. On the other hand, when transporting a patient across level terrain or within a hospital or other building it may be adequate for only one operator to accompany the emergency stretcher, the emergency stretcher may be in the raised or semi-raised condition so as to improve operator comfort and to reduce the risk of operator injury. Thus, a second operator becomes available to retrieve equipment from the ambulance or assist other patients, etc.

Optionally, an operator may use a remote-control unit, in particular a wireless remote-control unit, to control the track drive unit 100 from a safe distance. For instance, the operator may remotely pilot the track drive unit 100 equipped with an emergency stretcher 200 to a patient that is injured but still capable of climbing onto the fully lowered bed of the emergency stretcher 200. Once the patient has climbed onto the bed and preferably secured a patient restraint, the operator may remotely pilot the track drive unit 100 along a return path. The remote-control self-propelled mode is useful if the patient is in a hazardous area, such as for instance an area with biological, chemical, or nuclear contamination or even under combat conditions for military applications. Although remote-control operation of the emergency stretcher is not preferred it can nevertheless be used to retrieve a patient without putting an operator at risk, and without wasting valuable time waiting for specialized protective equipment to arrive and/or donning such protective equipment before entering a hazardous area.

In the description of the invention herein, it is understood that a word appearing in the singular encompasses its plural counterpart, and a word appearing in the plural encompasses its singular counterpart, unless implicitly or explicitly understood or stated otherwise. For instance, unless the context indicates otherwise, a singular reference, such as "a" or "an" means "one or more". Furthermore, it is understood that for any given component or embodiment described herein, any of the possible candidates or alternatives listed for that component may generally be used individually or in combination with one another, unless implicitly or explicitly understood or stated otherwise. Additionally, it will be understood that any list of such candidates or alternatives is merely illustrative, not limiting, unless implicitly or explicitly understood or stated otherwise. It is also to be understood, where appropriate, like reference numerals may refer to corresponding parts throughout the several views of the drawings for simplicity of understanding.

Throughout the description and claims of this specification, the words "comprise", "including", "having" and "contain" and variations of the words, for example "comprising" and "comprises" etc., mean "including but not limited to", and are not intended to (and do not) exclude other components.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example", "e.g." and like language) provided herein, is intended merely to better illustrate the invention and does not indicate a limitation on the scope of the invention unless otherwise claimed. No language in the specification should be construed as indicating any non-claimed element as essential to the practice of the invention.

Any steps described in this specification may be performed in any order or simultaneously unless stated or the context requires otherwise.

All of the features disclosed in this specification may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

What is claimed is:

1. A self-propelled track drive module for an emergency stretcher, comprising:

a left-side track drive unit and a right-side track drive unit;

a frame having a front end and a rear end and being disposed between the left-side track drive unit and the right-side track drive unit, the frame comprising a mounting structure for receiving an emergency stretcher and for releasably securing the emergency stretcher to the frame; and a power plant configured to power the left-side track drive unit and the right-side track drive unit independently of one another, wherein the mounting structure is configured to support the emergency stretcher such that rolling wheels of the emergency stretcher do not contact a ground surface therebelow when the emergency stretcher is in a mounted condition.

2. The self-propelled track drive module of claim 1, wherein the mounting structure comprises four channel supports, each channel support being generally U-shaped with an open top and being spaced relative to each of the other channel supports and relative to the frame for receiving one of the rolling wheels of the emergency stretcher.

3. The self-propelled track drive module of claim 1, wherein the power plant comprises a battery, a left-side electric track drive motor in electrical communication with the battery, and a right-side electric track drive motor in electrical communication with the battery, the left-side and the right-side electric track drive motors powering the left-side track drive unit and the right-side track drive unit, respectively.

4. The self-propelled track drive module of claim 1, wherein the power plant comprises one of a gasoline-powered engine and a diesel-powered engine.

5. The self-propelled track drive module of claim 1, comprising a controller for receiving a user input for controlling the left-side track drive unit and the right-side track drive unit.

6. The self-propelled track drive module of claim 1, comprising a controller for receiving a user input for controlling the left-side track drive unit and the right-side track drive unit.

7. A system for transporting a patient, comprising:

an emergency stretcher comprising:

a bed upon which the patient is placed for transport;

a scissor lift assembly supporting the bed in a height-adjustable fashion; and a first set of caster wheels carried by the front-end of the scissor lift and a second set of caster wheels carried by the rear-end of the scissor lift; and a self-propelled track drive module, comprising:

a left-side track drive unit and a right-side track drive unit; and a frame having a front end and a rear end and being disposed between the left-side track drive unit and the right-side track drive unit, the frame comprising a mounting structure for receiving the emergency stretcher and for releasably securing the emergency stretcher to the frame; and a power plant configured to power the left-side track drive unit and the right-side track drive unit independently of one another, wherein the mounting structure is configured to support the emergency stretcher such that the first set of caster wheels and the second set of caster wheels do not contact a ground surface therebelow when the emergency stretcher is in a mounted condition.

8. The system for transporting a patient of claim 7, wherein the mounting structure comprises four channel supports, two of the four channel supports being adjacent the front end of the frame and two of the four channel supports being adjacent the rear end of the frame, each channel support being generally U-shaped with an open top and being spaced relative to each of the other channel supports and relative to the frame for receiving one of the caster wheels carried by the scissor-lift of the emergency stretcher.

9. The system for transporting a patient of claim 7, wherein the power plant comprises a battery, a left-side electric track drive motor in electrical communication with the battery, and a right-side electric track drive motor in electrical communication with the battery, the left-side and the right-side electric track drive motors powering the left-side track drive unit and the right-side track drive unit, respectively.

10. The system for transporting a patient of claim 7, wherein the power plant comprises one of a gasoline-powered engine and a diesel-powered engine.

11. The system for transporting a patient of claim 7, comprising a controller for receiving a user input for controlling the left-side track drive unit and the right-side track drive unit.

12. The system for transporting a patient of claim 7, comprising a controller for receiving a user input for controlling the left-side track drive unit and the right-side track drive unit.

13. A method for transporting a patient, comprising:

releasably securing an emergency stretcher to a self-propelled track drive module, wherein:

the emergency stretcher comprises a bed upon which the patient is placed for transport, a scissor lift system for supporting the bed in a height-adjustable fashion, and a set of caster wheels for rolling on a ground surface; and the self-propelled track drive module comprises a left-side track drive unit and a right-side track drive unit and a frame having a front end and a rear end and being disposed between the left-side track drive unit and the right-side track drive unit, the frame comprising a mounting structure for receiving the emergency; and wherein the caster wheels do not contact a ground surface therebelow when the emergency stretcher is mounted to the self-propelled track drive module;

transporting the patient over a first terrain in a self-propelled mode of operation in which the tracks of the self-propelled track drive module engage a ground surface of the first terrain and are powered by an on-board power plant thereof, wherein the power plant is configured to power a left-side track drive unit of the track drive module and a right-side track drive of the track drive module independently of one another;

releasing the emergency stretcher from the self-propelled track drive module and placing the set of caster wheels into contact with a ground surface of a second terrain; and transporting the patient over the ground surface of the second terrain in a manually propelled mode of operation in which the emergency stretcher rolls on the set of caster wheels.

14. The method of claim 13, wherein transporting the patient over the ground surface of the second terrain in the manually propelled mode of operation comprises at least loading the emergency stretcher into an ambulance.

15. The method of claim 13, wherein the ground surface of the second terrain is at least one of smoother, harder packed and more even compared to the ground surface of the first terrain.

16. The method of claim 14, wherein the ground surface of the second terrain is at least one of smoother, harder packed and more even compared to the ground surface of the first terrain.

* * * * *